US007207146B1

(12) United States Patent
Morrell

(10) Patent No.: US 7,207,146 B1
(45) Date of Patent: Apr. 24, 2007

(54) MULTIPLE PURPOSE WALL BLOCK

(76) Inventor: Kelly J Morrell, 8350 Decathlon Dr., Spicer, MN (US) 56288

( * ) Notice: Subject to any disclaimer, the term of this patent is extended or adjusted under 35 U.S.C. 154(b) by 0 days.

(21) Appl. No.: 10/437,565

(22) Filed: May 14, 2003

(51) Int. Cl.
*E04C 3/30* (2006.01)

(52) U.S. Cl. ..... 52/561; 52/605; 52/592.6; 405/284; 405/285

(58) Field of Classification Search ..... 52/592.6, 52/604, 605; 405/284, 286, 287, 262
See application file for complete search history.

(56) References Cited

U.S. PATENT DOCUMENTS 468,838 A * 2/1892 Steiger ..... 52/284
800,067 A * 9/1905 Brooke ..... 52/592.6
2,392,551 A * 1/1946 Roe ..... 52/586.2
4,815,897 A * 3/1989 Risi et al. ..... 405/284
4,860,505 A * 8/1989 Bender ..... 405/286
5,031,376 A * 7/1991 Bender et al. ..... 52/609
5,252,017 A * 10/1993 Hodel ..... 411/446
5,277,012 A * 1/1994 Woolbright ..... 52/591.1
5,294,216 A * 3/1994 Sievert ..... 405/286
5,622,456 A * 4/1997 Risi et al. ..... 405/284
5,623,797 A * 4/1997 Gravier et al. ..... 52/284
5,960,604 A * 10/1999 Blanton ..... 52/604
6,062,772 A * 5/2000 Perkins ..... 405/284
6,253,519 B1 * 7/2001 Daniel ..... 52/591.1
6,312,197 B1 * 11/2001 Woolford et al. ..... 405/286
6,539,682 B1 * 4/2003 Ryder ..... 52/437
6,616,382 B2 * 9/2003 Woolford et al. ..... 405/284
6,651,401 B2 * 11/2003 Price et al. ..... 52/604
6,715,965 B2 * 4/2004 Manthei et al. ..... 405/284
6,735,913 B2 * 5/2004 Sanders et al. ..... 52/284

* cited by examiner

*Primary Examiner*—Kimberly Wood
(74) *Attorney, Agent, or Firm*—Moore & Hansen, PLLP

(57) ABSTRACT

A block used to construct a wall. The block has a front and rear surfaces, top and bottom surfaces, and side surfaces. The bottom surface of the block has a projection that extends downwardly therefrom and which is configured to engage one or more blocks in an adjacent course of blocks to prevent movement therebetween. Depending upon the configuration of the wall, the projection may engage a portion of the rear surface of an adjacent course of blocks, or may be received within one of two channels in the top surface of the adjacent course of blocks. By selecting the position of the projection relative to the adjacent course of blocks, differently configured walls may be constructed.

21 Claims, 6 Drawing Sheets

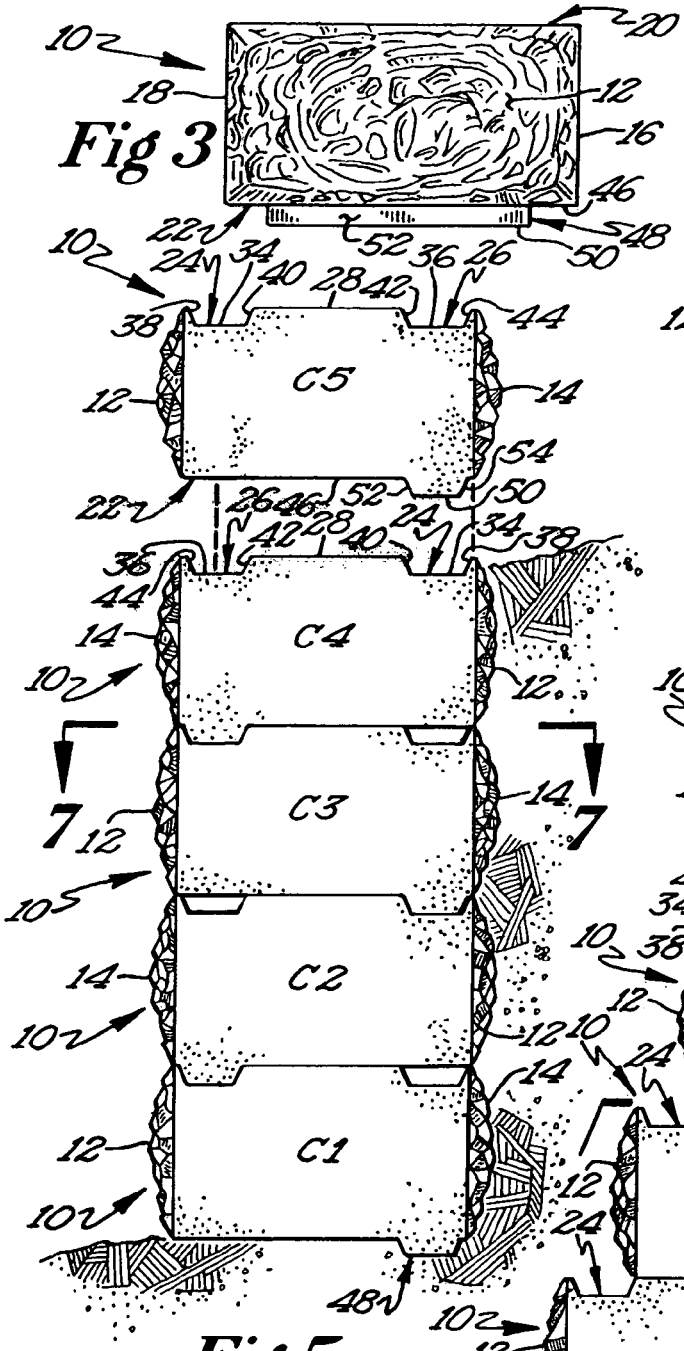
Fig 3
C5
C4
C3
C2
C1
7
7
Fig 5
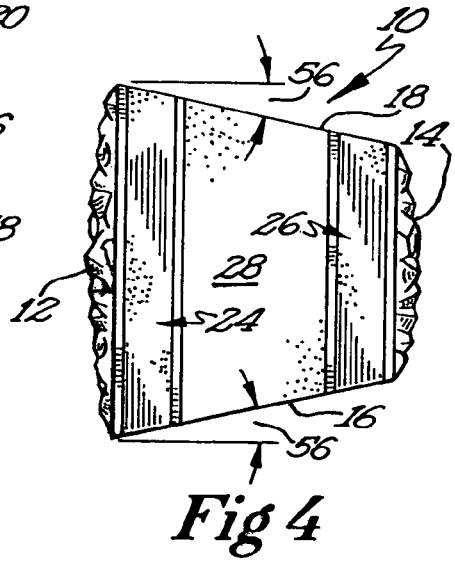
Fig 4
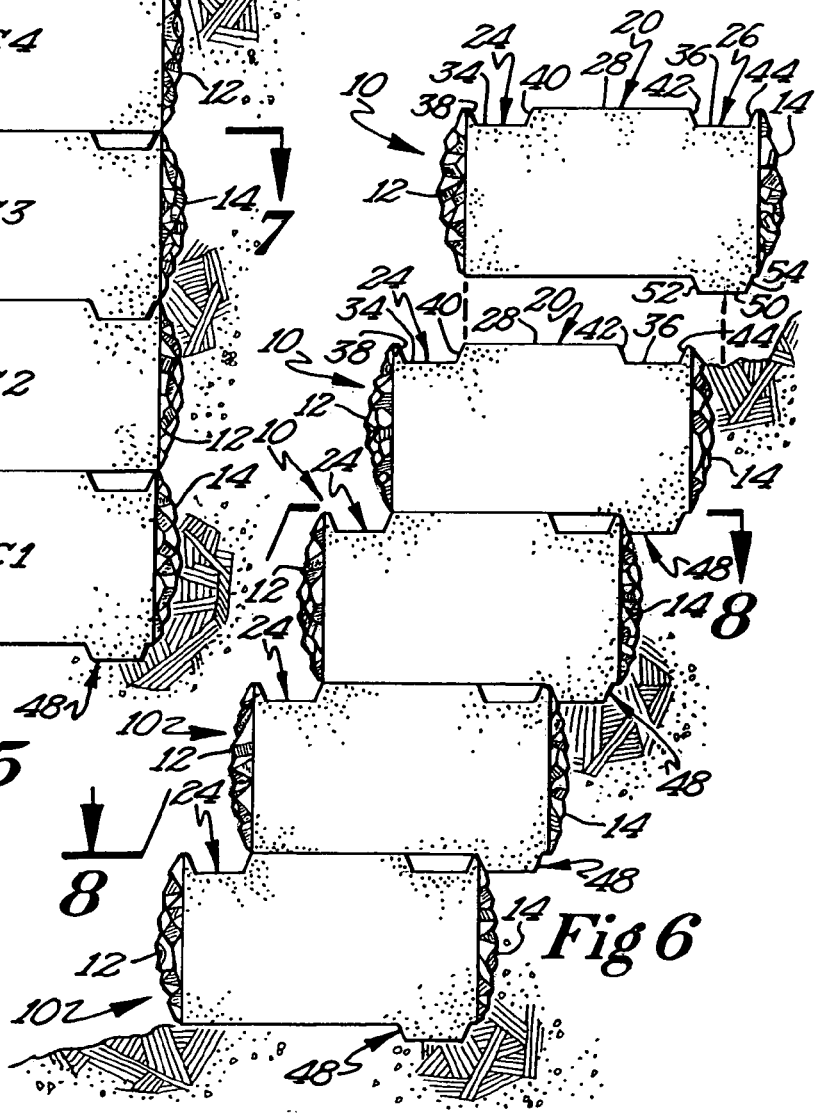
8
8
Fig 6

MULTIPLE PURPOSE WALL BLOCK

FIELD OF THE INVENTION

The present invention generally relates to masonry blocks. More particularly, the present invention relates to mortarless masonry blocks that may be used to construct vertical freestanding walls or sloping walls.

BACKGROUND OF INVENTION

Mortarless masonry blocks have been known and used for many years. They are quite popular because they do not require extensive site preparation or the services of skilled craftsmen, and they are aesthetically pleasing, invoking feelings of stability, durability, and permanence. Besides being attractive and sturdy, they are generally small enough to be able to be lifted and manipulated by one person. They can range from about 6–120 pounds but more typically, though, they range around 35–70 pounds. In addition, they characteristically have only one facing or exposed face with an area in the range of about 0.17 to 1.00 square feet, and have corresponding volumes that range from about 126 to 2880 cubic inches. Such masonry blocks are commonly used to construct low retaining walls or planters, for example.

Most mortarless masonry blocks are manufactured using a process known in the trade as dry casting. With this process, block material having a comparatively low percentage of water (as opposed to block material that is wet cast) is deposited into an open-ended, unitary mold that is positioned on a palette and compacted by a movable piston as it moves towards the palette. Once the desired amount of compaction has been achieved, the compacted material is ejected or stripped from the mold by lifting the mold and/or moving the piston relative to the palette, or by vibrating the mold as it is moved away from the palette. The molded block is then cured outside of the mold in a series of separate steps.

This process allows many blocks to be manufactured in a comparatively rapid fashion because the molds are not required for the curing process. As will be understood, then, in order for these types of molds to be used most efficiently, they are usually constructed and arranged to facilitate extrusion or stripping. Most molds, therefore, comprise a vertically walled, unitary frame with no indentations or protrusions that would hinder extrusion or stripping. Blocks produced by such molds are usually symmetrically shaped so that the block may be subsequently split into two smaller, similarly shaped blocks, with each block having a substantially planar roughened facing. Alternatively, some molds may have walls with small transverse bottom ledges, or roughened divider walls, which are designed to work an uncured surface of a block as it is stripped from the mold. As will be understood, such ledges or divider walls are only capable of producing a substantially planar roughened surface, similar to the surfaces produced using the splitting technique described above.

A drawback with the afore-mentioned manufacturing techniques is that they are unable to produce a block that has a roughened facing that is bowed or curved with respect to the extrusion or stripping direction. If such a bowed facing is desired, the block must be worked after it has been stripped from the mold and cured, for example, by additional processing steps such as tumbling or grinding. As one may imagine, each additional processing step adds to the time and cost of the finished product.

A drawback with the afore-mentioned dry cast blocks is that that they are relatively small. This does not present much of a problem when retaining walls are less than 4 or 5 courses high. However, for retaining walls whose heights exceed 4 or 5 courses, it is usually necessary to provide stabilization devices to counteract the forces exerted by backfill material. Stabilization devices usually take the form of flexible sheets of a mesh-like synthetic material known in the trade as geo-grids, for example, which are usually positioned between courses of blocks and which extend horizontally and rearwardly into the backfill material that is being retained. Stabilization devices such as geo-grids may be connected to blocks by connectors, but usually they are frictionally retained in place between courses by the weight of the blocks pressing down on them. Often, it is necessary to provide stabilization devices for each course of blocks or for every other course of blocks, which adds to the cost of materials, labor, and time of construction. Unfortunately, stabilization devices can stretch, break, or be pulled out from the wall structure, which can lead to premature wall failure.

Another drawback common to most dry cast blocks is that they usually have only one facing or exposed face area. Thus, they are limited to a particular orientation within a structure. This limitation is underscored when the blocks are trapezoidal in shape, for example.

Another drawback common to most dry cast blocks is that they are designed and configured to engage vertically adjacent blocks in certain, predetermined arrangements. For example, some blocks are designed so that they can only be used to build vertical walls, while other blocks are designed so that they can only be used to build walls that have a predetermined batter or upwardly receding slope. Engagement between vertically adjacent blocks is most commonly achieved by providing blocks with integrally formed lips or protrusions that are designed to engage vertically adjacent blocks. Alternatively, engagement between vertically adjacent blocks may be achieved by providing connectors or pins that tie the blocks together.

Thus, there is a need for a masonry block that can be used to construct different wall structures. There is also a need for a masonry block that can be positioned in one of several predetermined orientations relative to vertically adjacent blocks to create different types of wall structures. There is also a need for a block that is able to engage vertically adjacent blocks without the use of extraneous devices or connectors. And, there is a need for a block that is capable of resisting normal forces without having to be operatively connected to stabilization devices such as geo-grids and/or earth anchors.

SUMMARY OF THE INVENTION

The present invention is directed to masonry blocks that may be used to construct different types of wall structures. The masonry blocks have front and back surfaces, opposing side surfaces, a top surface, and a bottom surface, and are configured so that when they are arranged in a wall structure comprising multiple courses, the blocks of adjacent courses are able to interlock or engage each other so that they are better able to resist forces normal to the wall structure.

The top surface and bottom surfaces of each block include at least one channel and a projection, respectively. Preferably, the top surface of each block has two channels. The channels and the projection of each block are substantially linear and are aligned with each other so that they extend in the same direction relative to the block, such as across the width of the block between its opposing sides. Each channel is configured to be able to constrainingly retain one or more projections of vertically adjacent blocks to prevent forward and backward movement therebetween. The channels are arranged so that they lie adjacent the front and rear surfaces of the block, respectively, while the projection is arranged so that it lies adjacent the rear surface of the block, in vertical alignment with rearmost of the two channels.

The provision of the two channels and the projection allow the blocks to be used to construct different types of walls. One type of wall, for example, is a substantially vertical wall. And, within that type, different styles may be constructed. A substantially vertical wall may be constructed in which the front surfaces of all of the blocks are all on the same side of the wall, as with a running bond, for example. Such a wall will have only one side that has a substantially monolithic appearance, without large-gapped joints between adjacent blocks.

Alternatively, a substantially vertical wall may be constructed in which the blocks of each course of blocks are arranged in an alternating manner so that a front surface is between two rear surfaces, and a rear surface is between two front surfaces. This style of construction will result in a wall with opposing sides that appear substantially the same. That is, both sides of the wall have a substantially monolithic appearance. Another substantially vertical wall may be constructed in which a majority of blocks are positioned so that their front surfaces are on the viewable side of the wall and the remainder of the blocks are positioned in a somewhat random manner so that their rear surfaces are also on the viewable side of the wall. This style of construction will result in a wall having only one substantially monolithic appearing side.

Another type of wall that can be constructed using the blocks of the present invention is a sloping wall, where the wall has a predetermined batter. With this type of wall, the projections of blocks are not retained within the channels of vertically adjacent blocks. Rather, the projections are positioned so that they contact the upper margins of the rear surfaces of vertically adjacent blocks. This positions the block rearwardly with respect to the adjacent, lower block. An advantage with this type of wall structure is that it is better able to resist forces exerted by material it is retaining. Another advantage with this type of wall is that the wall may be arranged in a serpentine manner.

An object of the present invention is to provide a masonry block that may be used to construct a freestanding, substantially vertical wall.

Another object of the invention is to provide a masonry block that may be used to construct a wall having a predetermined batter or slope.

Yet another object of the present invention is to provide a block that has the size and bulk to be able to resist pressure exerted by retained material without having to be operatively connected to extraneous anchoring devices.

A feature of the present invention is that blocks in adjacent courses of blocks are able to interlock without the use of extraneous connectors.

Another feature of the present invention is that the block may be oriented in a variety of positions relative to adjacent blocks.

An advantage of the invention is that the block may be used to construct substantially vertical walls, walls having a slope or batter, walls comprising a combination of vertical and sloping portions, or serpentine walls.

Another advantage of the invention is that the block may be interlocked with blocks in adjacent courses of blocks without modifications or adaptors.

These and other objects, features and advantages of the present invention will become apparent from the following detailed description thereof taken in conjunction with the accompanying drawings, wherein like reference numerals designate like elements throughout the several views.

BRIEF DESCRIPTION OF THE DRAWINGS

FIG. 3 is front elevational view of the preferred embodiment of FIG. 1;

FIG. 4 is a top plan view of the preferred embodiment of FIG. 1;

FIG. 5 is a cross-sectional view of a wall construction comprising a plurality of blocks arranged in substantially vertical courses;

FIG. 6 is a cross-sectional view of a wall construction comprising a plurality of blocks arranged in a plurality of offset courses;

DETAILED DESCRIPTION OF THE INVENTION

Figure 1:
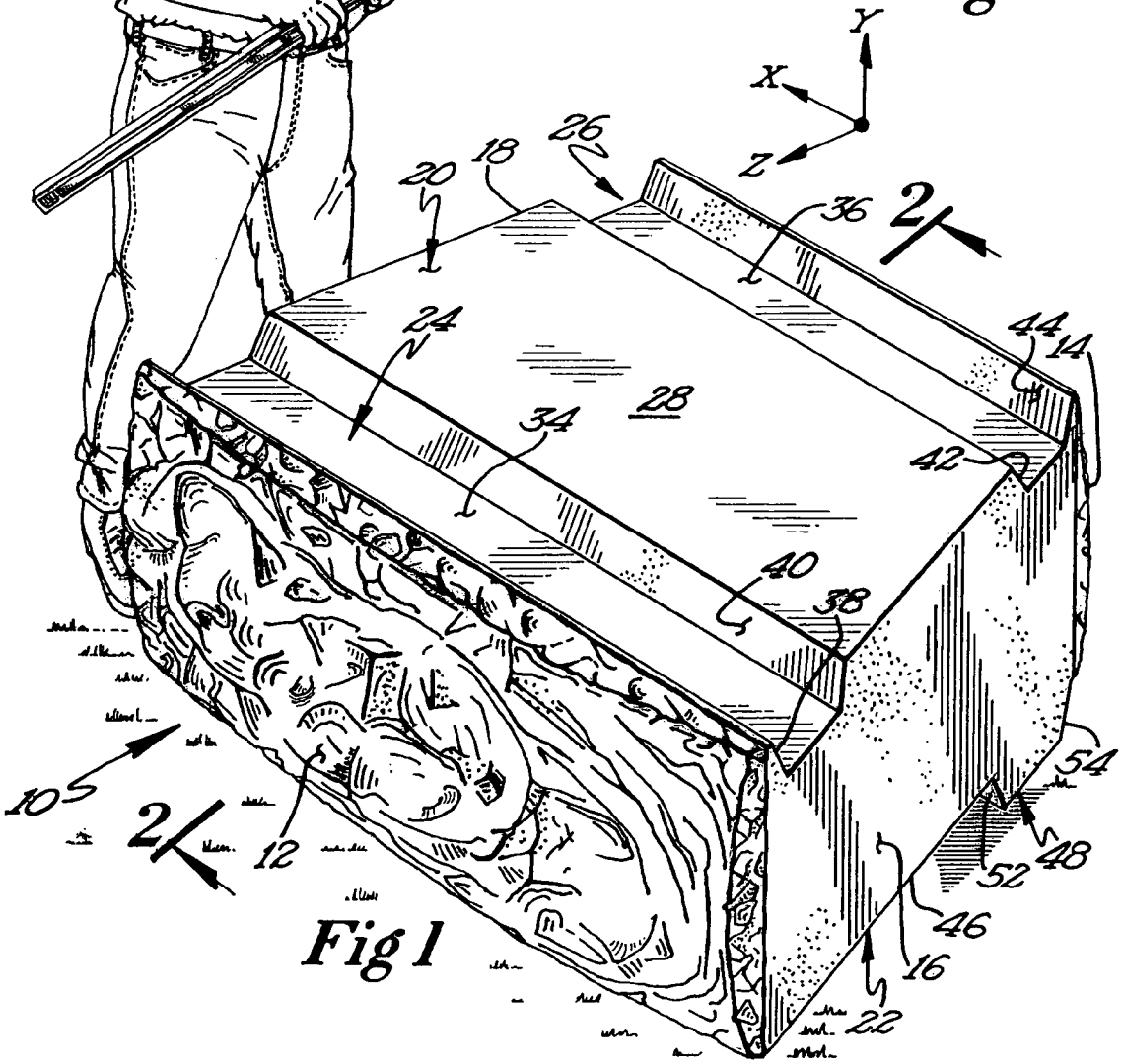
FIG. 1 is a perspective view of a preferred embodiment of the block of the present invention in juxtaposition with an averaged sized adult worker.

A preferred embodiment of a block of the present invention is depicted in FIG. 1. As can be seen, the block 10 is generally trapezoidally shaped and includes a front surface 12, a rear surface 14, a pair of opposed side surfaces 16 and 18 that extend between the front 12 and rear 14 surfaces, a top surface 20, and a bottom surface 22. The front surface 12, as shown, is rough textured and substantially non-planar, and extends outwardly with respect to the front edges of the top, bottom, and opposed side surfaces. Preferably, the maximum extent or relief of the outward extension is in the range of about 2.5 to 33.3 percent of the height of the block, taken in the y direction in a three-dimensional coordinate system. The rear surface 14 is similarly textured (see, for example, FIGS. 2, 4, and 7–12) and also extends outwardly with respect to the rear edges of the top, bottom, and opposed side surfaces. As with the front surface 12, the maximum outward extent or relief of the rear surface 14 is preferably in the range of about 2.5 to 33.3 percent of the height of the block, again taken in the y direction in a three-dimensional coordinate system. The maximum extent or relief of the outwardly extending front 12 and rear 14 surfaces is more clearly shown in FIG. 2. As depicted, the front and rear edges of the top 20 and bottom 22 surfaces define imaginary front 30 and rear 32 planes (shown in dashed lines), from which the maximum extents are measured. As applied to a block having a height in the range of about 18 inches, and a depth in the range of about 34 inches (as measured between the imaginary front and rear planes 30, 32), the maximum outward extent at each of the front and rear surfaces would be on the order of 0.35 to 6.00 inches, for example, and the total depth of the block could be increased from about ¾ of an inch to about 12 inches.

The top surface 20, as depicted, has two channels 24 and 26 that are spaced apart from each other by a center section 28. Preferably, both of the channels 24 and 26 are substantially linear and aligned so that they extend in the same direction, relative to the block 10. As depicted, this is preferably in the x direction in a three-dimensional coordinate system, across the width of the block and between the opposing side surfaces 16 and 18. The center section 28 is substantially planar and also preferably extends across the width of the block, between the opposing side surfaces 16 and 18.

Figure 2:
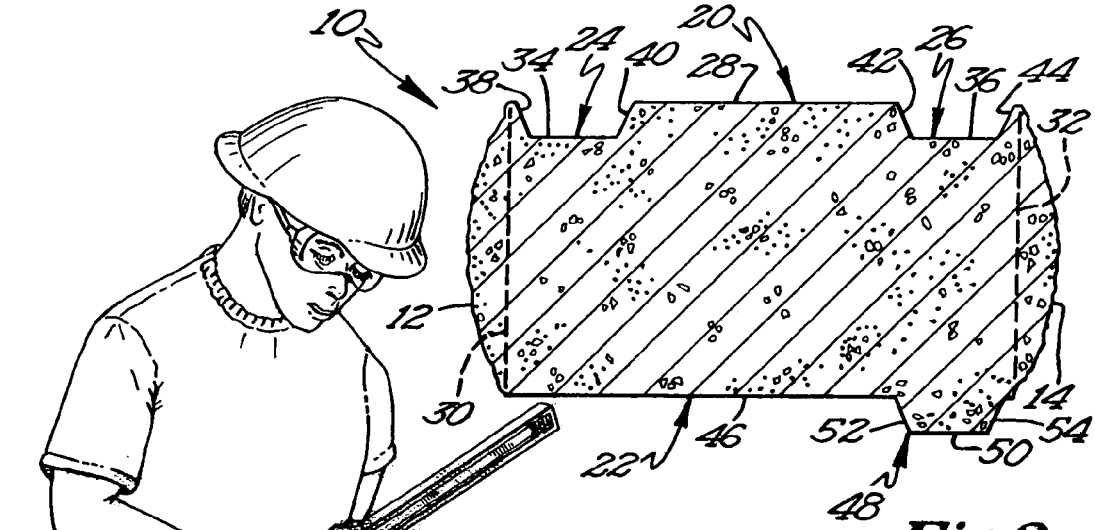
FIG. 2 is a cross-sectional view taken along lines 2—2 of FIG. 1.

As depicted in FIG. 2, each of the channels 24, 26 of the top surface 20 comprises a floor 34, 36 and a pair of side walls 38, 40, and 42, 44, respectively. Preferably, the side walls 38, 40, and 42, 44 of the channels 24 and 26 are angled away from each other so that the channels are wider at the top surface 20 than at their respective floors 34 and 36. As will be appreciated, the angled side walls 38, 40, and 42, 44 facilitate engagement with projections of vertically adjacent blocks, and also reduce the potential for chipping.

The bottom surface 22 includes a bottom section 46 and a projection 48, with the projection comprising a base 50 and a pair of engagement surfaces 52 and 54. Preferably, the engagement surfaces 52 and 54 are angled towards each other so that the projection tapers towards the base 50. As with the channels, the angled engagement surfaces 52 and 54 facilitate engagement with channels of vertically adjacent blocks, and they also reduce the potential for chipping.

Preferably, the projection 48 is located adjacent the rear surface 14 of the block 10 so that it is in vertical alignment with the rearmost channel 26. As with the channels, the projection 48 is also substantially linear. In addition, the projection 48 is aligned with the channels 24 and 26 such that it also extends substantially across the width of the block between the side surfaces 16 and 18, as shown in FIG. 3.

The top surface 20 of the block 10, as shown in FIG. 4, is generally trapezoidal in shape with the side surfaces 16 and 18 angled towards each other from the front 12 surface to the rear surface 14. As will be appreciated, these angled side surfaces 16 and 18 permit the blocks to be arranged into a serpentine manner, without forming gaps between the side surfaces of adjacent blocks (see, for example, FIG. 12). Preferably, the angle 56 that the side surfaces make with respect to the z direction in a three-dimensional coordinate system (see, FIG. 1) is in the range of between 0 and 30 degrees, and more preferably on the order of about 6 to 23 degrees.

Figure 7:
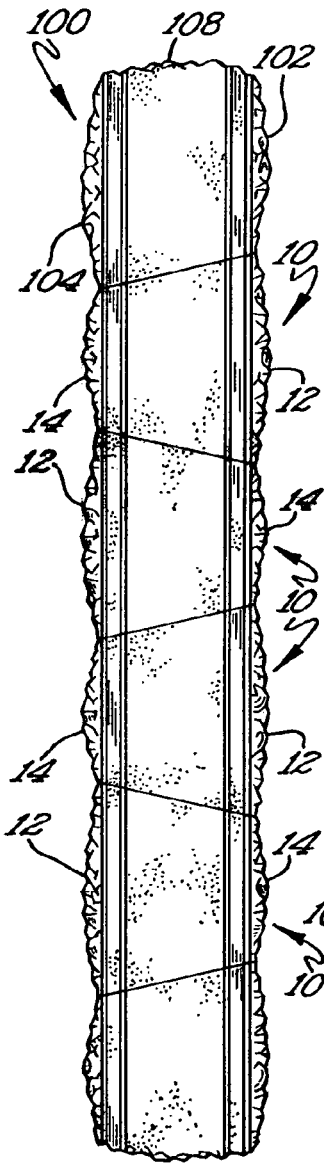
FIG. 7 is a top plan view of a course of blocks in the wall construction of FIG. 5.

It will be appreciated that the blocks of the present invention may be arranged in a variety of different manners. For example, the blocks could be arranged so that some of the front surfaces of the blocks and some of the rear surfaces of the blocks are on the same side of the wall. This arrangement would result in a substantially vertical wall, as depicted in FIG. 5. Note, in FIG. 5 that there are five courses of blocks, and that the courses are arranged in an alternating manner. More specifically, the blocks in the first C1, third C3, and fifth C5 courses have their front surfaces showing, while the blocks in the second C2, and fourth C4 courses have their rear surfaces showing. This alternating arrangement is best depicted in FIG. 7. Note that such an arrangement could be used to construct a wall structure that can approximate a unitary, poured wall having a minimum amount of voids. It will be appreciated that the blocks may be arranged differently, if desired. For example, the blocks could be arranged so that the front surfaces face in the same direction and the courses of blocks could be arranged in a running bond, with the projection of the upper course of blocks engaging the second, rearmost channel of the lower course of blocks. This arrangement could be used to construct a substantially vertical wall (see, for example, FIG. 14). Or, the blocks may be arranged in a more random manner, so that most of the blocks have their front surfaces on the same side. It will be understood that in all of the above described vertical wall constructions, the projections will engage the channels of vertically adjacent blocks.

Alternatively, the front surfaces could face in the same direction, and the courses of blocks could be arranged in a running bond. However, instead of engaging the rearmost channel, with the projections of the upper course of blocks engage the upper edges of the rear surfaces of the lower course of blocks, as depicted in FIG. 6. This arrangement could be used to construct a wall in which courses are offset from each other, as is common in many retaining walls (see, FIG. 8).

Figure 9:
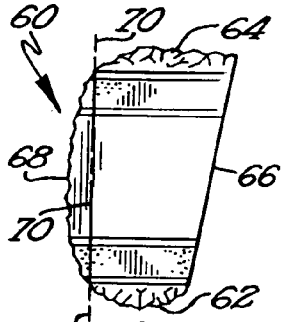
FIG. 9 is an alternative embodiment of FIG. 1 of the present invention.
Figure 10:
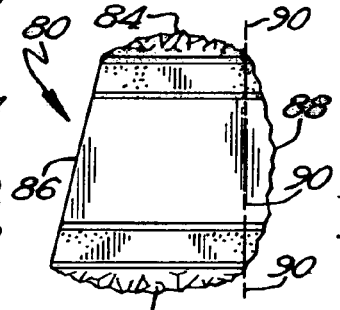
FIG. 10 is an alternative embodiment of FIG. 1 of the present invention.
Figure 11:
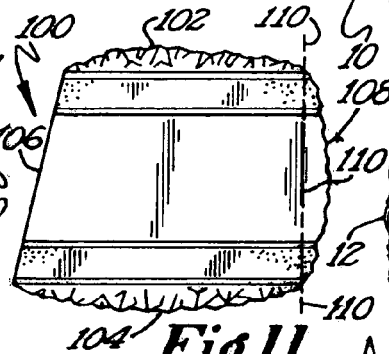
FIG. 11 is an alternative embodiment of FIG. 1 of the present invention.
Figure 8:
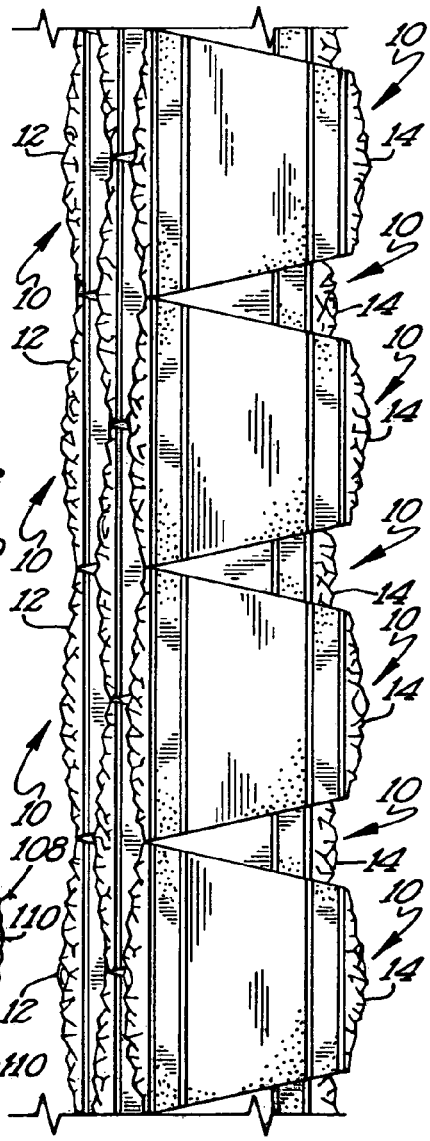
FIG. 8 is a top plan view of a plurality of courses of blocks in the wall construction of FIG. 6.
Figure 12:
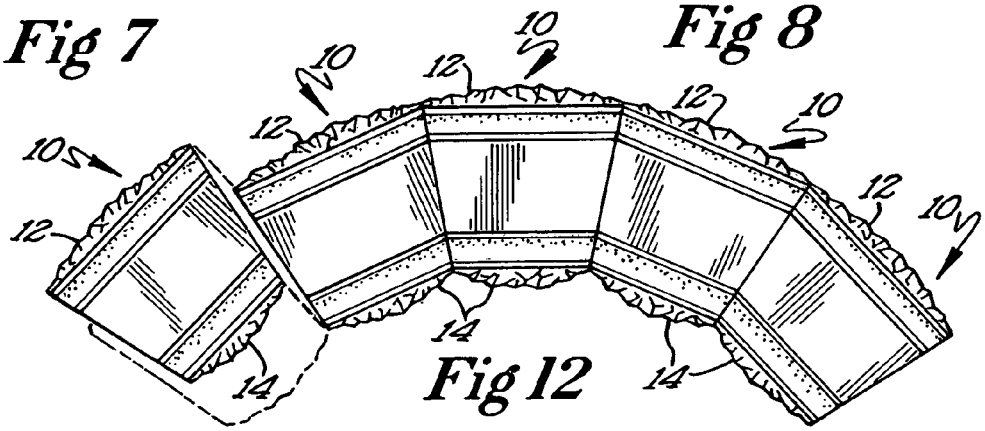
FIG. 12 is a top plan view of a course of a wall construction using the blocks of FIG. 1.

FIGS. 9, 10, and 11 depict preferred embodiments of masonry blocks that may be used at the ends of walls. These preferred embodiments are similar to the above-described blocks in that they have a front surface, a rear surface, opposing side surfaces, a top surface, and a bottom surface. The top surface also include a pair of channels and a central section, with the channels being substantially linear and in alignment with each other between the side surfaces of the block. The bottom surface also includes a bottom section and a projection that is linearly shaped, which extends between the side surfaces, and which is in vertical alignment with the rearmost of the two channels.

More specifically, FIGS. 9, 10, and 11 represent three additional embodiments of different sizes of blocks that are based upon the trapezoidal block of the preferred embodiment of FIGS. 1, 4, 8, and 12. The block 60 of FIG. 9 shares some of the same dimensions as those of the trapezoidal block, namely depth and height (taken along the z and y directions in a three-dimensional coordinate system, see FIG. 1). However, the front, rear, and one of the opposing side surfaces are different than the corresponding surfaces of the trapezoidal block. As depicted, the front 62 and rear 64 surfaces are substantially smaller than the front and rear surfaces of the trapezoid of FIGS. 1, 4, 8, and 12. Preferably, the front surface 62 is in the range of about 20 to 50 percent of the width of the front surface 12 of a trapezoidal block, while the rear surface 64 is in the range of about 50 to 100 of the width of a rear surface 14 of a trapezoidal block. More preferably, the front surface is on the order of about 26 to 40 percent, while the rear surface is on the order of about 68 to 82 percent. As applied to a block 10 having a front 12 and rear 14 surfaces having widths in the range of around 48 and 32 inches, the widths of the front 62 and rear 64 surfaces of block 60 would be in the range of about 9.6–24.0, and 16.0–32.0 inches, for example.

As opposed to a generally trapezoid shape having two angled (opposing) side surfaces, block 60 has only one angled side surface 66 while the other, opposing side surface 68 is generally perpendicular to the front 62 and rear 64 surfaces. Preferably, the side surface 68, as shown, has a roughened texture similar to the front and rear surfaces of the previously described trapezoidally shaped block. The side surface 68 also extends outwardly with respect to an imaginary plane (depicted as dashed line 70) extending from the front to the rear surfaces in the z direction in a three dimensional coordinate system (see, FIG. 1). The maximum extent or relief of the outward extension is in the range of about 2.5 to 33.3 percent of the height of the block, taken in the x direction in a three-dimensional coordinate system (see, FIG. 1). As applied to a block having a height in the range of about 18 inches, the maximum outward extend of the front and rear surfaces would be on the order of 0.35 to 6.00 inches, for example.

The block 80 depicted in FIG. 10 is slightly larger than the block of FIG. 9, yet it is still smaller than the trapezoidal block as previously described. Preferably, the front surface 82 is in the range of about 50 to 100 percent of the width of the front surface 12 of a trapezoidal block 10, while the rear surface 84 is in the range of about 50 to 100 of the width of a rear surface 14 of a trapezoidal block 10. More preferably, the front surface is on the order of about 60 to 75 percent, while the rear surface is on the order of about 68 to 82 percent. As applied to a block having a front and rear surfaces having widths in the range of around 48 and 32 inches, respectively, the widths of the front 82 and rear 84 surfaces of block 80 would be in the range of about 24–48, and 16–32 inches, for example. Block 80 has only one angled side surface 86 while the other, opposing side surface 88 is generally perpendicular to the front 82 and rear 84 surfaces. Preferably, the side surface 88, as shown, has a roughened texture similar to the front and rear surfaces of the previously described trapezoidally shaped block. The side surface 88 also extends outwardly with respect to an imaginary plane (depicted as dashed line 90) extending from the front to the rear surfaces in the z direction in a three dimensional coordinate system (see, FIG. 1). The maximum extent or relief of the outward extension is in the range of about 2.5 to 33.3 percent of the height of the block, taken in the x direction in a three-dimensional coordinate system (see, FIG. 1). As applied to a block having a height in the range of about 18 inches, the maximum outward extend of the front and rear surfaces would be on the order of 0.35 to 6.00 inches, for example.

The block depicted in FIG. 11 is slightly larger than the trapezoidal block previously described. Preferably, the front surface 102 is in the range of about 70 to 100 percent of the width of the front surface 12 of a trapezoidal block 10, while the rear surface 104 is in the range of about 125 to 175 percent of the width of a rear surface 14 of a trapezoidal block 10. More preferably, the front surface is on the order of about 75 to 90 percent, while the rear surface is on the order of about 140 to 160 percent. As applied to a block having a front and rear surfaces having widths in the range of around 48 and 32 inches, respectively, the widths of the front 102 and rear 104 surfaces of block 100 would be in the range of about 33–48, and 40–56 inches, for example. Block 100 has only one angled side surface 106 while the other, opposing side surface 108 is generally perpendicular to the front 102 and rear 104 surfaces. Preferably, the side surface 108, as shown, has a roughened texture similar to the front and rear surfaces of the previously described trapezoidally shaped block. The side surface 108 also extends outwardly with respect to an imaginary plane (depicted as dashed line 110) extending from the front to the rear surfaces in the z direction in a three dimensional coordinate system (see, FIG. 1). The maximum extent or relief of the outward extension is in the range of about 2.5 to 33.3 percent of the height of the block, taken in the x direction in a three-dimensional coordinate system (see, FIG. 1). As applied to a block having a height in the range of about 18 inches, the maximum outward extend of the front and rear surfaces would be on the order of 0.35 to 6.00 inches, for example. As will be appreciated, the above-described blocks enable the ends of a wall to be finished in the same manner as with the front and rear surfaces of the blocks. Thus creating a finished appearance.

Figure 13:
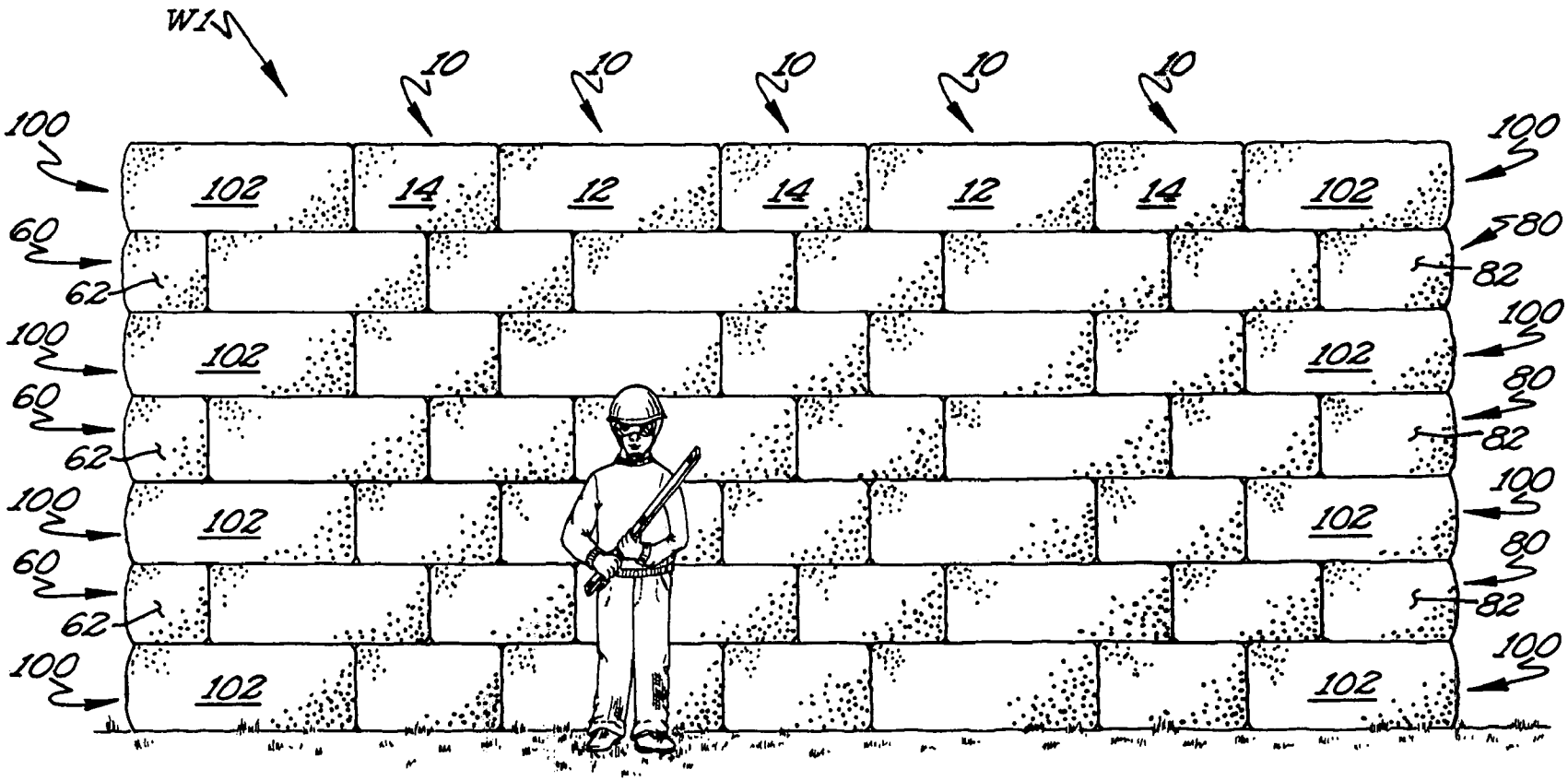
FIG. 13 is a front elevational view of a wall construction using the blocks of the present invention, in juxtaposition with a normally sized adult worker.
Figure 14:
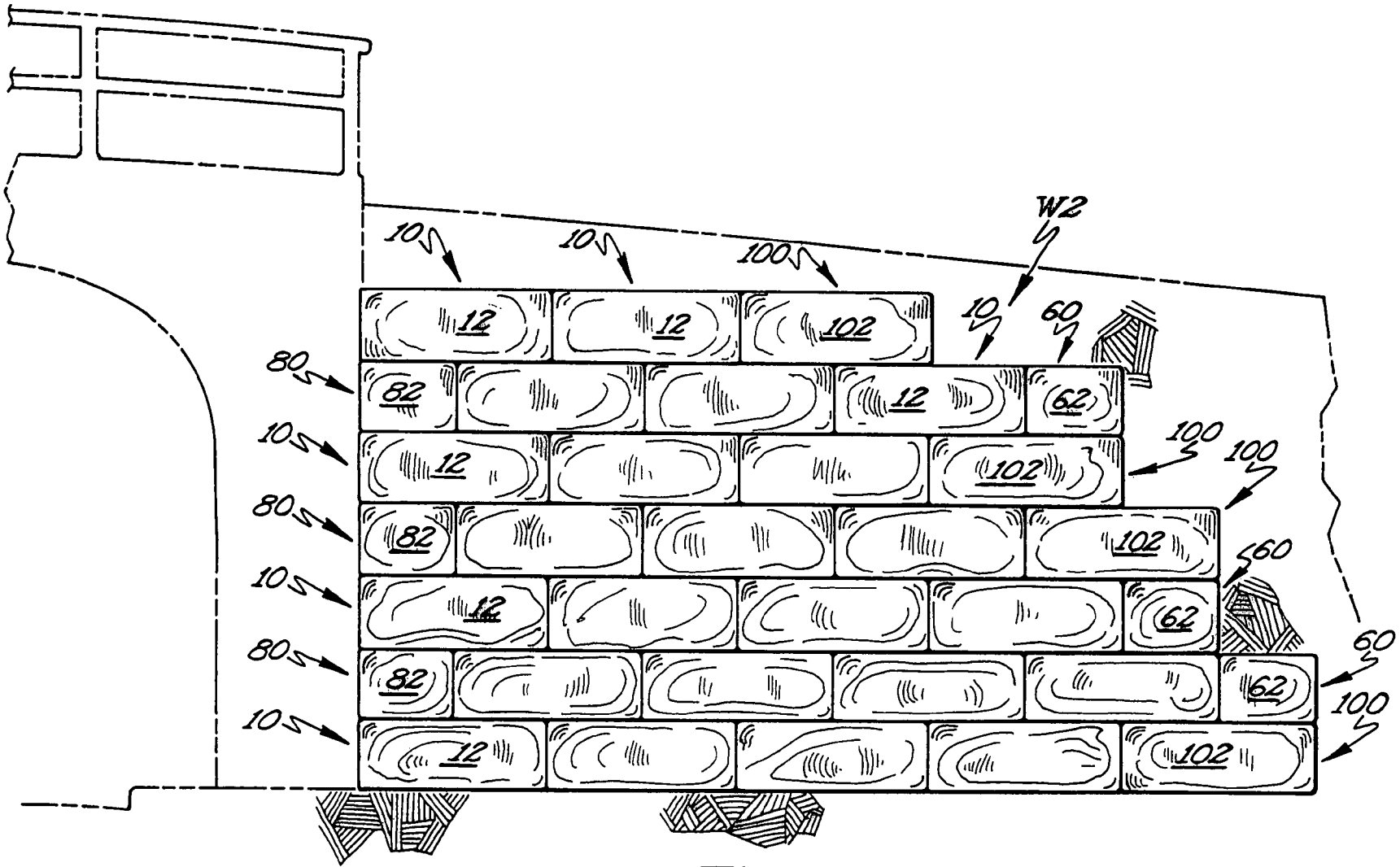
FIG. 14 is front elevational view of a wall construction used to retain backfill.

Examples of walls constructed with the above-described blocks are depicted in FIGS. 13 and 14. In FIG. 13, W1 is substantially vertical wall having two sides or faces and opposing ends, with the opposing ends generally parallel to each other and generally transverse to the faces of the wall W1. As will be noted, wall W1 is constructed so that the interior blocks 10 are positioned in an alternating manner, while the end blocks 60, 80, and 100, are selected based so that they form a common end surface. In FIG. 14, wall W2 is depicted as being used as a retaining wall. In this embodiment, most of the blocks 10 are trapezoidal and have their front surfaces facing the viewer. It will be understood that this type of wall may be either a substantially vertical wall or a sloping wall.

Figure 15:
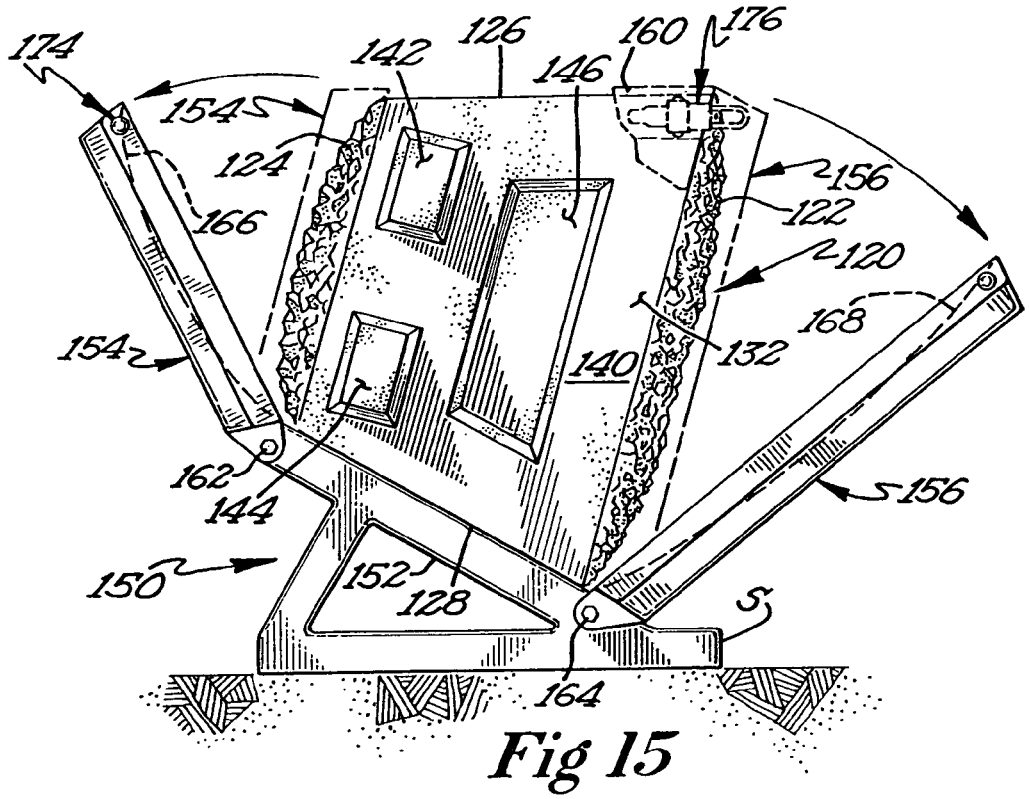
FIG. 15 is side elevational view of an alternative embodiment of the block of the present invention and an open mold in which the block was cast; and, FIG. 16 is a top plan view of the block of FIG. 15 as it would be cast in a closed mold.
Figure 16:
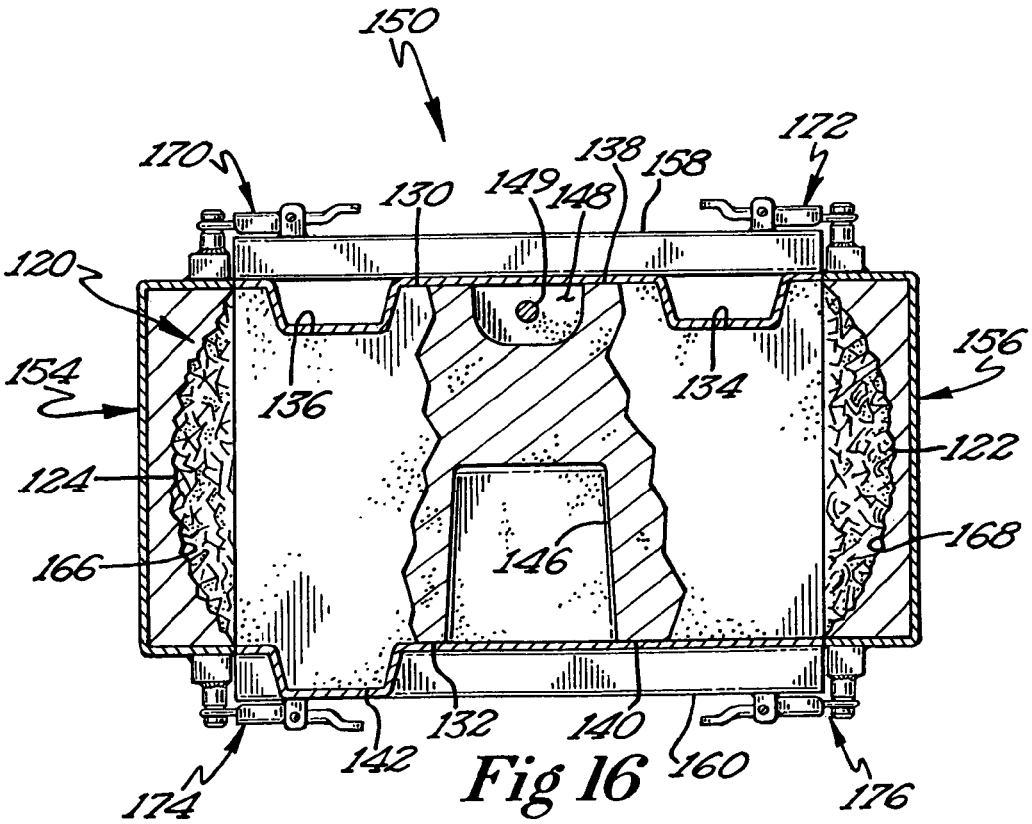

An alternative embodiment of the block of the present invention and a preferred mold are depicted in FIGS. 15 and 16. Referring to FIG. 15, the block 120 of this embodiment is generally trapezoidally shaped and includes a front surface 122, a rear surface 124, a pair of opposed side surfaces 126 and 128 that extend between the front 122 and rear 124 surfaces, a top surface 130, and a bottom surface 132. The front and rear surfaces 122 and 124, as shown, are rough textured and extend outwardly with respect to the front edges of the top, bottom, and opposed side surfaces The bottom surface 132 comprises a bottom section 140 and a plurality of projections 142, 144, with each projection comprising a base and a pair of engagement surfaces. Preferably, the engagement surfaces of each projection are angled towards each other so that the projection tapers towards the base (see, FIG. 16). Preferably, the projections 142, 144 are located adjacent the rear surface 124 of the block 120 so that they are in vertical alignment with the rearmost channel 136 (see, FIG. 16). As can be seen, the projections 142, 144 are aligned in the x direction of a three-dimensional coordinate system across the width of the block 120 between the side surfaces 126 and 128 (compare with FIG. 1). Since the weight of the block 120 may become quite large and unmanageable, even for a skid-steer loader, one or more cores can be used to reduce the weight without reducing the overall dimensions of the block. Such a core can be used advantageously at the bottom section 140 to produce a core hole 146, for example. This can allow more blocks to be loaded onto a transport, which saves time and money.

The top surface 130, as depicted from the side in FIG. 16, has two channels 134 and 136 that are spaced apart from each other by a center section 138. Preferably, both of the channels 134 and 136 are substantially linear and aligned so that they extend in the same direction, relative to the block 120. This is preferably in the x direction in a three-dimensional coordinate system, across the width of the block and between the opposing side surfaces 126 and 128 (compare with FIG. 1). The center section 138 is substantially planar and also preferably extends across the width of the block 120, between the opposing side surfaces 126 and 128.

Optionally, the center section may be provided with a cylindrically shaped indentation 148 with a transverse or axial rod or wire 149, which forms a lifting point for the block 120.

While it will be appreciated that different methods and processes may be used to manufacture the aforementioned block embodiments, the inventor has discovered that the larger sized blocks are best suited for manufacture using the wet casting process. Moreover, it has been discovered that dimensional accuracy and consistency can be more easily achieved if the blocks are cast on their sides so that the front and rear surfaces are vertical. FIG. 15 depicts a block 120 that is being removed from mold 150. As shown, the bottom or base 152 of the mold is positioned on a support "S" so that the side surface 126 of the block is more or less horizontal. Side walls 154 and 156, having textured surfaces 166, 168, and which are removably attached to the base 152 by pivot pins 162 and 164, have been unlatched from the other similarly attached side walls 158 and 160 (see, FIG. 16) of the mold 150 and swung away from contact with the block surfaces 124, 126. In this position, the block is now ready for removal from the mold. As will be understood, the side walls of the mold are attached to each other by latches 170, 172, 174, 176, in a conventional manner.

An advantage to forming the block on its side is that it ensures that the mold material is disbursed evenly along the channels and along the front and rear surfaces. In addition, it is easier to form the block such that the distance between the top and bottom surfaces is consistent and within manufacturing specifications. With the preferred method of casting, only one side of the block need be hand finished. And, as will be appreciated, this will not appreciably affect wall construction.

While preferred embodiments of the present invention have been shown and described, it should be understood that various changes, adaptations, and modifications may be made therein without departing from the spirit of the invention. Changes may be made in details, particularly in matters of shape, size, material, and arrangement of parts without exceeding the scope of the invention. Accordingly, the scope of the invention is as defined in the language of the appended claims.

What is claimed is:

1. A block for use in constructing a wall, the block comprising:

a rough textured, non-faceted, substantially convex front surface;

a rough textured, non-faceted, substantially convex rear surface;

a pair of opposed side surfaces extending between the front and rear surfaces;

a top surface, the top surface comprising a first channel, with each channel including inwardly tapered side walls and a bottom surface, and a second channel, with the first and second channels spaced from each other by a substantially planar top section, and with at least one of the first or second channels extending substantially across the width of the block between the opposed side surfaces;

a bottom surface, the bottom surface comprising a substantially planar bottom section and a projection, with the projection extending substantially across the width of the block between the opposed side surfaces, with the projection having a substantially uniform cross-section, with the projection being located adjacent the bottom section in substantial vertical alignment with one of the first and second channels, and with the projection configured to engage a channel in an adjacent course of blocks.

2. The block of claim 1, wherein the side surfaces are angled inwardly towards each other.

3. The block of claim 2, wherein rear surface has a width that is less than the width of the front surface.

4. The block of claim 1, wherein the block has a weight greater than 70 pounds.

5. The block of claim 1, wherein the block has a volume greater than 400 cubic inches.

6. The block of claim 1, wherein the front surface has an outward extent in the range of about 2.5 to 33.3 percent of the distance between the top and bottom surfaces of the block, with the outward extent measured relative to the plane defined by the front edges of the top, bottom, and opposed side surfaces.

7. The block of claim 1, wherein the rear surface has an outward extent in the range of about 2.5 to 33.3 percent of the distance between the top and bottom surfaces of the block, with the outward extent measured relative to the plane defined by the rear edges of the top, bottom, and opposed side surfaces.

8. A block for use in constructing a wall, the block comprising:

a rough textured, non-faceted, substantially convex front surface;

a rough textured, non-faceted, substantially convex rear surface;

a pair of opposed side surfaces extending between the front and rear surfaces a top surface, the top surface comprising a substantially planar central section and a channel having inwardly tapered side walls and a bottom surface, and, with the channel located adjacent the central section and extending between the side surfaces;

a bottom surface, the bottom surface comprising a substantially planar bottom section and a projection, with the projection extending substantially across the width of the block between the opposed side surfaces, with the projection having a substantially uniform cross-section, with the projection being located adjacent the bottom section in substantial vertical alignment with the channel, and with the projection configured to engage a channel in an adjacent course of blocks.

9. The block of claim 8, wherein the channel is adjacent the front surface of the block.

10. The block of claim 8, wherein the channel is adjacent the rear surface of the block.

11. The block of claim 1, wherein the area of the substantially planar bottom section is greater than the area of the substantially planar top section of the top surface.

12. The block of claim 1, wherein the one of the opposing side surfaces is rough textured, non-faceted, and substantially convex.

13. The block of claim 12, wherein the rough textured, non-faceted, substantially convex opposing side surface has an outward extent in the range of about 2.5 to 33.3 percent of the distance between the top and bottom surfaces of the block.

14. The block of claim 8, wherein the front surface has an outward extent in the range of about 2.5 to 33.3 percent of the distance between the top and bottom surfaces of the block, with the outward extent measured relative to the plane defined by the front edges of the top, bottom, and opposed side surfaces.

15. The block of claim 8, wherein the rear surface has an outward extent in the range of about 2.5 to 33.3 percent of the distance between the top and bottom surfaces of the block, with the outward extent measured relative to the plane defined by the rear edges of the top, bottom, and opposed side surfaces.

16. The block of claim 8, wherein the forwardmost edges of the top, bottom and opposed side surfaces define a front plane, wherein the rearwardmost edges of the top, bottom and opposed side surfaces define a rear plane, wherein the front and rear planes are substantially parallel, and wherein each of the front and rear surfaces curve outwardly in both vertical and horizontal directions with respect to said substantially parallel front and rear planes.

17. The block of claim 16, wherein the channel is located between the substantially parallel front and rear planes.

18. The block of claim 8, wherein the opposing side surfaces are non-parallel.

19. The block of claim 8, wherein the one of the opposing side surfaces is rough textured, non-faceted, and substantially convex.

20. The block of claim 17, wherein the rough textured, non-faceted, substantially convex opposing side surface has an outward extent in the range of about 2.5 to 33.3 percent of the distance between the top and bottom surfaces of the block.

21. The block of claim 8, wherein the area of the substantially planar bottom section is greater than the area of the substantially planar central section of the top surface.

* * * * *